US007040197B2

(12) United States Patent
Wu

(10) Patent No.: US 7,040,197 B2
(45) Date of Patent: May 9, 2006

(54) OPENER PROVIDING LARGE ARM OF FORCE

(76) Inventor: Weng-Gong Wu, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/867,415

(22) Filed: Jun. 15, 2004

(65) Prior Publication Data

US 2005/0274232 A1 Dec. 15, 2005

(51) Int. Cl.
*B25B 13/00* (2006.01)

(52) U.S. Cl. ..... 81/58.1; 81/61

(58) Field of Classification Search ..... 81/58.1, 81/58, 61, 121, 125, 177, 436, 437
See application file for complete search history.

(56) References Cited

U.S. PATENT DOCUMENTS 2,620,001 A * 12/1952 Fratz et al. ..... 81/177.1
2,621,688 A * 12/1952 Wales ..... 81/436
3,438,413 A * 4/1969 Borah ..... 81/177.1
3,475,999 A * 11/1969 Roberts et al. ..... 81/63
4,007,651 A * 2/1977 Scott ..... 81/175
4,206,794 A * 6/1980 Reese ..... 81/30
4,212,336 A * 7/1980 Smith ..... 81/436
5,152,196 A * 10/1992 Garrett ..... 81/58.1
6,116,123 A * 9/2000 Chen ..... 81/177.2

* cited by examiner

*Primary Examiner*—Lee D. Wilson
*Assistant Examiner*—Alvin J Grant

(57) ABSTRACT

An opener comprises a holding portion; a front end of the holding portion being installed with a screwing portion; a rear end of the holding portion being installed with a rotation portion; a front end of the screwing portion being installed with an opener head; a rear end of the rotation portion being installed with a connecting hole for receiving a tool so as to provide a longer arm of force to have a larger torque, thus the user can moving a screwing element easily by using the opener. A section of the rotation portion is received into the holding portion; the section of the rotation portion is installed with at least one buckling ring for enhancing the engagement of the rotation portion with the holding portion. A front end of the portion of the rotation portion has a connecting sleeve; the screwing portion is tightly received into the connecting sleeve.

2 Claims, 5 Drawing Sheets

OPENER PROVIDING LARGE ARM OF FORCE

FIELD OF THE INVENTION

The present invention relates to openers, and particular to an opener which can be connected to a tool for providing a larger arm of force to drive a screwing element. Moreover, the opener has a larger structural strength.

BACKGROUND OF THE INVENTION

The prior art opener has a holding portion with a larger diameter so that when using the opener to rotate the screwing element to release or tighten the screwing element. In general, the user must tightly hold the handle of the opener for rotating the screwing element. If it is used for a longer time, the hand of the user will feel ache, in fact, the hand will hurt.

To improve the prior art defect, an auxiliary handle extends from and vertical to the handle of a spanner so as to provide a larger arm of force in rotating a screwing element. However, the defect of this prior art is that since a larger arm of force is provided, the auxiliary handle is easy to deform. Moreover, to install the auxiliary handle, a recess is formed in the handle. As a result, the strength of the handle will be decreased. Thus, the handle is easily destroyed. Moreover, to install the auxiliary handle to the handle, the auxiliary handle cannot be formed to match the requirement of ergonomics so as to match the shape of wrist.

SUMMARY OF THE INVENTION

Accordingly, the primary object of the present invention is to provide an opener which can be connected to a tool for providing a larger arm of force for driving a screwing element. Moreover, the opener has a larger structural strength.

To achieve above objects, the present invention provides an opener which comprises a holding portion; a front end of the holding portion being installed with a screwing portion; a rear end of the holding portion being installed with a rotation portion; a front end of the screwing portion being installed with an opener head; a rear end of the rotation portion is installed with a connecting hole for receiving a tool so as to provide a longer arm of force to have a larger torque, thus the user can turn screwing element easily by using the opener. A section of the rotation portion is received into the holding portion; and the section of the rotation portion is installed with at least one buckling ring for enhancing the engagement of the rotation portion with the holding portion. A front end of the section of the rotation portion has a connecting sleeve; the screwing portion is tightly received into the connecting sleeve.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, hut not to be used to confine the scope and spirit of the present invention defined in the appended claims.

Figure 1:
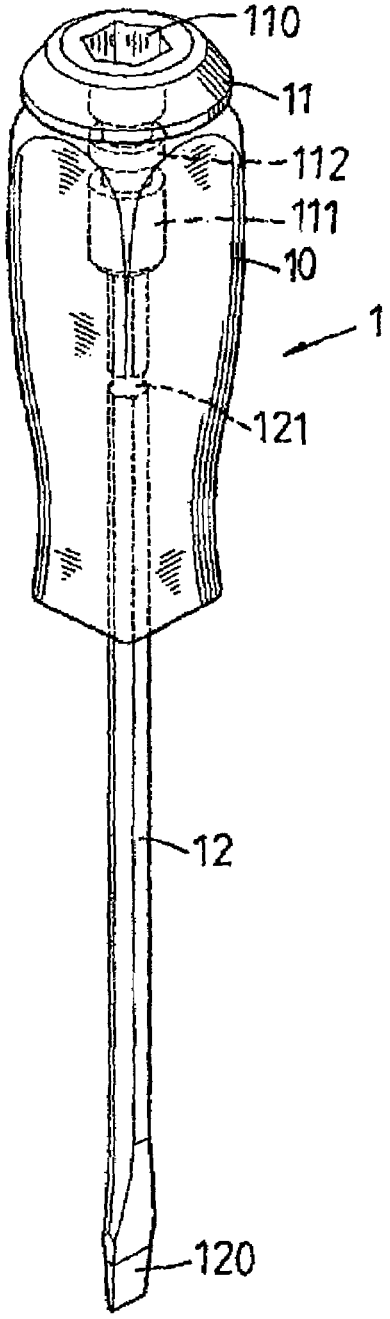
FIG. 1 is a perspective view of the opener of the present invention.
Figure 2:
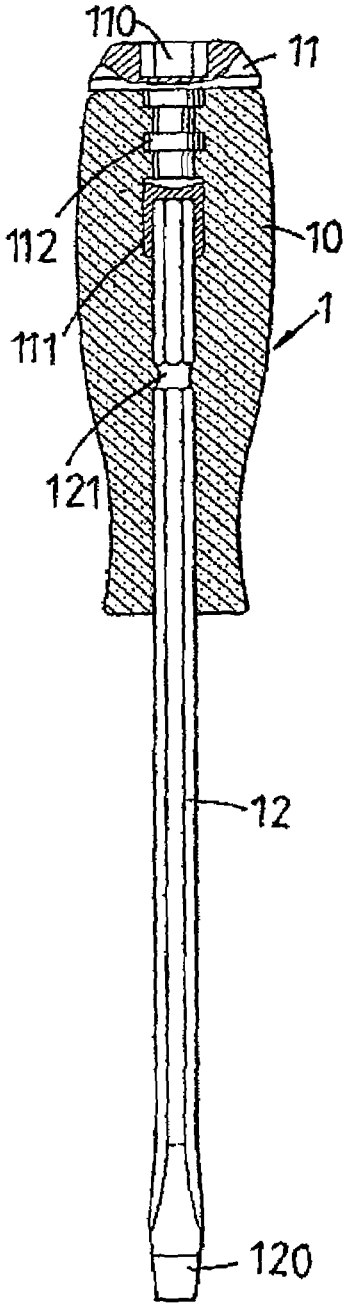
FIG. 2 is a partial schematic view of the opener of the present invention.

With reference to FIGS. 1 to 2, the opener structure of the present invention has an opener body 1 which comprises the following elements.

A rotation portion 11 is included. A distal end of the rotation portion 11 has a disk-like end and a post-like portion. A hexagonal hole 110 is formed in the disk-like end as a connecting hole. A moving tool can be inserted into the hexagonal hole 110. A front end of the rotation portion 11 is formed with a connecting sleeve 111 for engaging with a distal end of an opener head. A section of the rotation portion 11 other than the disk-like portion and the connecting sleeve 111 is installed with at least one buckling ring 112.

A screwing portion 12 is included. A front end of the screwing portion 12 has an opener head 120. The other portion of the screwing portion 12 is a hexagonal post. A distal end of the screwing portion 12 is received in the connecting sleeve 111 of the rotation portion 11 so as to be tightly engaged in the connecting sleeve 111. Near the distal end of the screwing portion 12 is formed with an annular recess 121.

A holding portion 10 is formed by injection molding. Before injection, the screwing portion 12 is received into the connecting sleeve 111 in a front end of the rotation portion 11. Then the holding portion 10 is injected and then encloses the rotation portion 11 and the screwing portion 12. The buckling ring 112 of the rotation portion 11 and the annular recess 121 of the screwing portion 12 serve for increasing the buckling force to the holding portion 10 to prevent the rotation portion 11 and the screwing portion 12 from separation.

Figure 3:
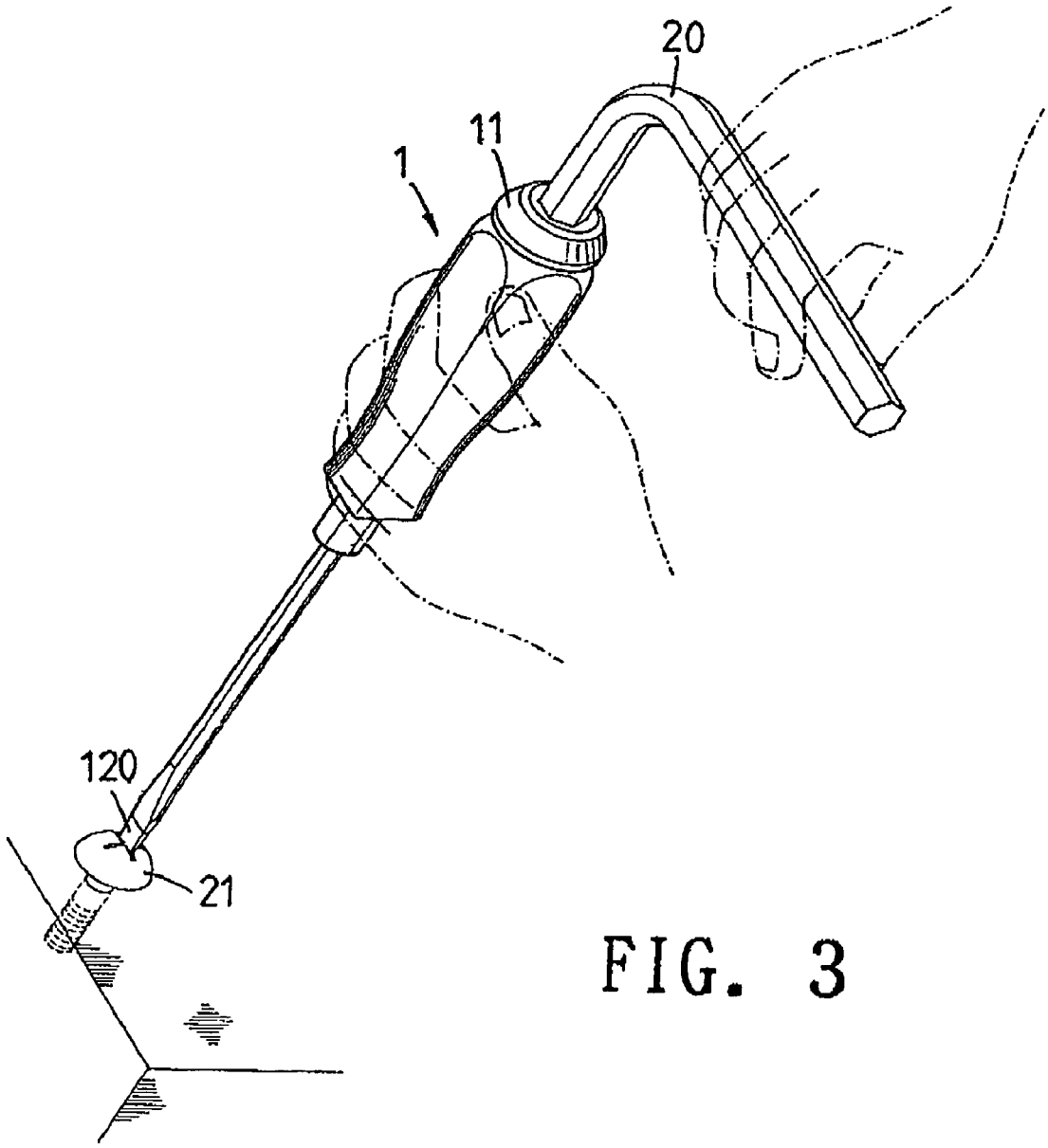
FIG. 3 shows the use of the present invention.

Referring to FIG. 3, in use of the present invention, the opener head 120 in front of the opener body 1 is engaged to a screwing element 21. When a larger rotating force is necessary, with a rotating tool, for example an inner hexagonal spanner 20. The inner hexagonal spanner 20 is inserted into the hexagonal hole 110 at the distal end of the opener body 1. Then the inner hexagonal spanner 20 is driven so as to drive the opener body 1 so as to have a larger torque. Thereby, the user can use less force to rotate the screwing element 21.

Figure 4:
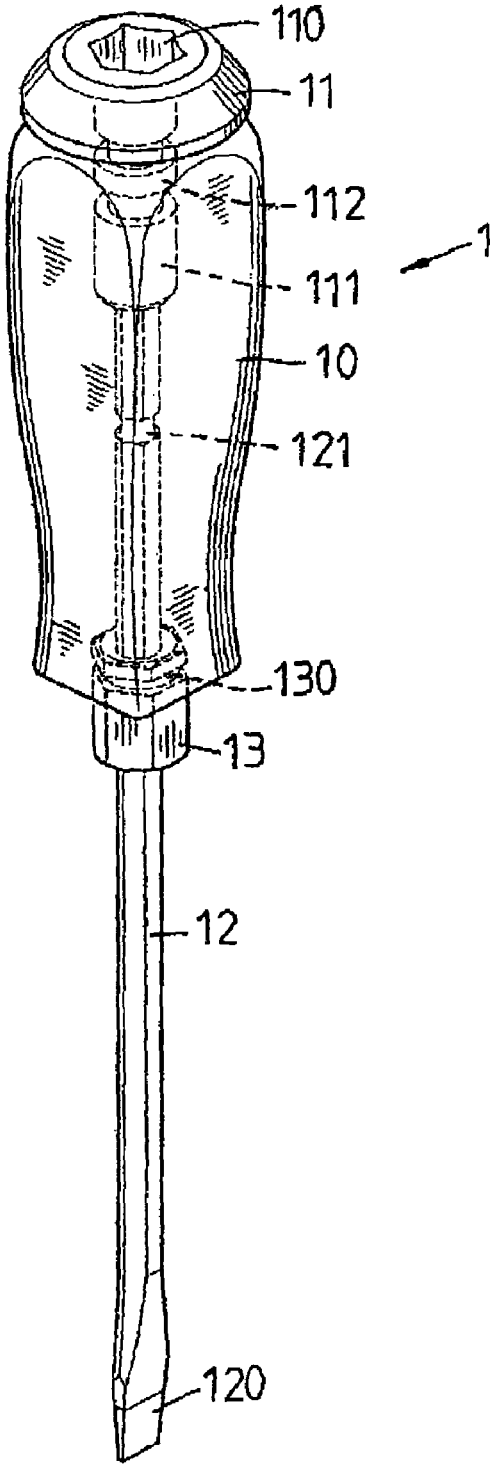
FIG. 4 shows the second embodiment of the present invention.
Figure 5:
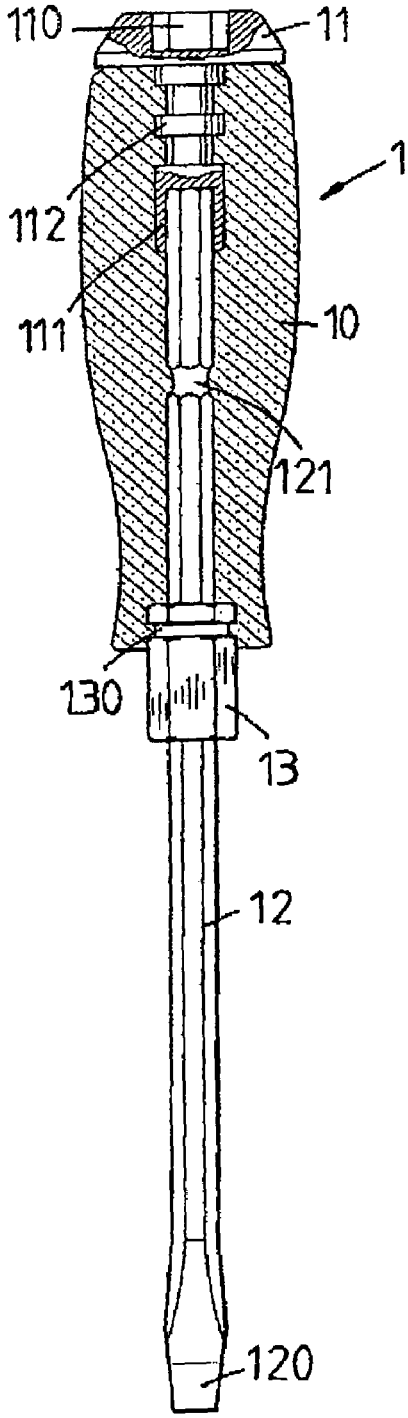
FIG. 5 shows the partial cross section view of the second embodiment of the present invention.

Referring to FIGS. 4 and 5, the second of the present invention is illustrated. The elements same as the first embodiment will be not further described here. To make the opener of the present invention can be used with more tools and to increase the arm of force in rotating the screwing element 21, a front end of the holding portion 10 is installed with a driving portion 13. The driving portion 13 can be received in the screwing portion 12 so as to drive the screwing portion 12. The outer side of the driving portion 13 is a hexagonal post. A distal end of the driving portion 13 is installed with a shoulder portion 130. When the driving portion 13 is enclosed within the holding portion 10, the shoulder portion 130 serves to increase the buckling force between the driving portion 13 and the holding portion 10 to prevent the driving portion 13 from separation from the holding portion 10.

Figure 6:
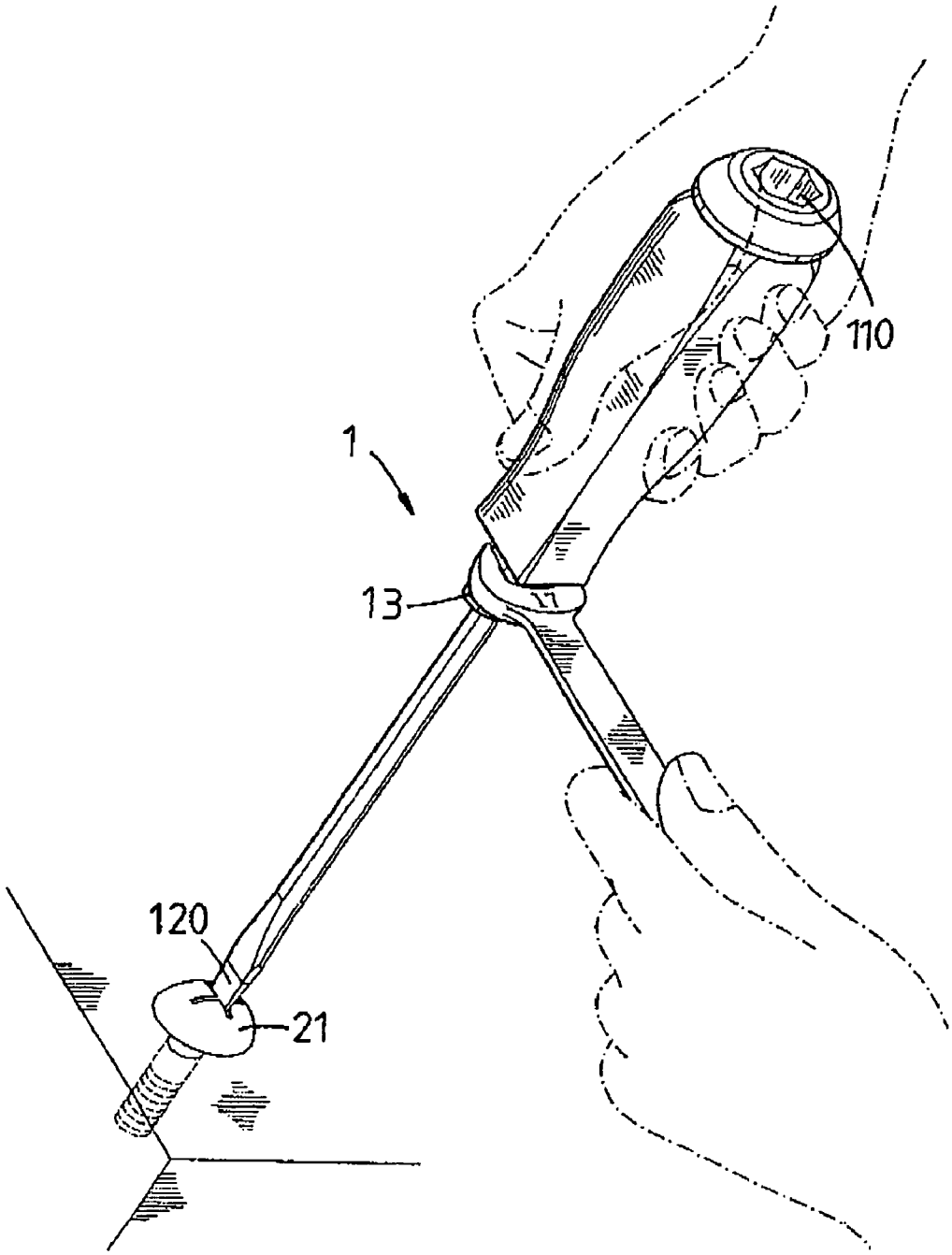
FIG. 6 shows the use of the present invention.

Referring to FIG. 6, in use of this the present invention, the hexagonal hole 110 is used with the hexagonal spanner 20 to increase the arm of force. Thereby, it can be used with a spanner so that the spanner can drive the driving portion 13 to provide a large torque to the opener body 1. Thereby, the user can easily rotate a screwing element 21.

Figure 7:
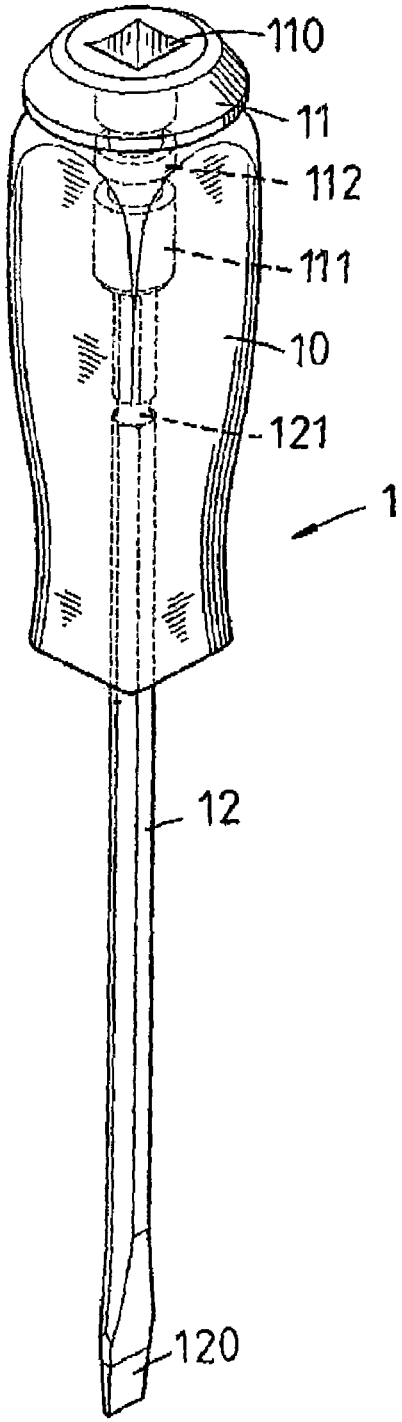
FIG. 7 is a perspective view of the third embodiment of the present invention.
Figure 8:
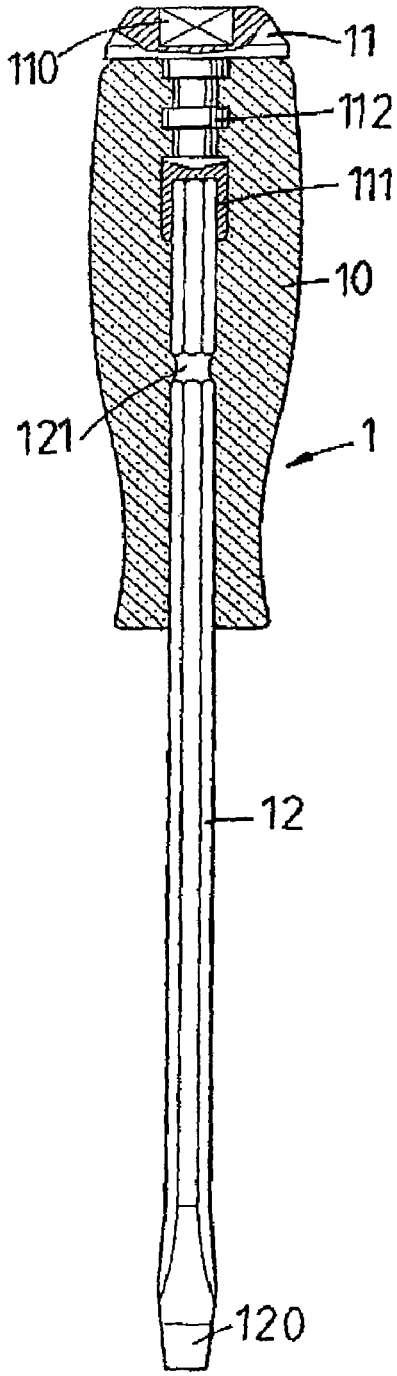
FIG. 8 shows a partial schematic view of the third embodiment of the present invention.

In the present invention, the opener head may have a straight type, a cruciform shape, a hexagonal shape, and others. With reference to FIGS. 7 and 8, another embodiment of the present invention is illustrated, where the hexagonal hole 110 is replaced by a rectangular hole 110.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An opener comprising:

a holding portion; a front end of the holding portion being installed with a screwing portion; a rear end of said holding portion being installed with a rotation portion; a front end of said screwing portion being installed with an opener head; a rear end of the rotation portion being formed with a connecting hole for receiving a tool to increase an arm of force of the opener to provide a larger torque to an object driven by said opener, wherein a section of the rotation portion is received into said holding portion; the section of the rotation portion is installed with at least one buckling ring for enhancing the engagement of the rotation portion with the holding portion;

wherein a front end of the section of the rotation portion has a connecting sleeve; the screwing portion tightly received into the connecting sleeve so that the screwing portion rotates with the rotation portion.

2. The opener as claimed in claim 1, wherein the driving portion is installed to the screwing portion; and the screwing portion installed at a front end of the holding portion so that the driving portion is driven by a tool so as to rotate the screwing portion.

* * * * *